US011036152B2

(12) United States Patent
Kobayashi et al.

(10) Patent No.: US 11,036,152 B2
(45) Date of Patent: Jun. 15, 2021

(54) TONER, IMAGE FORMING METHOD, IMAGE FORMING APPARATUS, AND PROCESS CARTRIDGE

(71) Applicants: Shohta Kobayashi, Shizuoka (JP); Satoshi Ogawa, Nara (JP); Yoshitaka Sekiguchi, Shizuoka (JP); Masayuki Ishii, Shizuoka (JP); Naoko Kitada, Shizuoka (JP)

(72) Inventors: Shohta Kobayashi, Shizuoka (JP); Satoshi Ogawa, Nara (JP); Yoshitaka Sekiguchi, Shizuoka (JP); Masayuki Ishii, Shizuoka (JP); Naoko Kitada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/492,986

(22) PCT Filed: Feb. 21, 2018

(86) PCT No.: PCT/JP2018/006323
§ 371 (c)(1),
(2) Date: Sep. 11, 2019

(87) PCT Pub. No.: WO2018/168373
PCT Pub. Date: Sep. 20, 2018

(65) Prior Publication Data

US 2020/0019076 A1 Jan. 16, 2020

(30) Foreign Application Priority Data

Mar. 13, 2017 (JP) ..... JP2017-047242

(51) Int. Cl.
*G03G 9/08* (2006.01)
*G03G 9/087* (2006.01)
(Continued)

(52) U.S. Cl.
CPC ..... *G03G 9/0819* (2013.01); *G03G 9/0825* (2013.01); *G03G 9/0827* (2013.01);
(Continued)

(58) Field of Classification Search
CPC ..... G03G 9/0819; G03G 9/0827
(Continued)

(56) References Cited

U.S. PATENT DOCUMENTS

2007/0122727 A1 5/2007 Ida et al.
2007/0275315 A1 11/2007 Nagatomo et al.
(Continued)

FOREIGN PATENT DOCUMENTS

EP 1950614 A1 7/2008
EP 2312399 A1 4/2011
(Continued)

OTHER PUBLICATIONS

International Search Report dated Apr. 26, 2018 for counterpart International Patent Application No. PCT/JP2018/006323 filed Feb. 21, 2018.
(Continued)

*Primary Examiner* — Mark A Chapman
(74) *Attorney, Agent, or Firm* — Oblon, McClelland, Maier & Neustadt, L.L.P.

(57) ABSTRACT

Provided is a toner including a binder resin, a release agent, and a charge-controlling agent, wherein the toner includes toner particles having particle diameters of 3 micrometers or smaller, among the toner particles having particle diameters of 3 micrometers or smaller, a proportion of the toner particles having an average circularity of 0.70 or greater but 0.85 or less in all of the toner particles is 10% by number or greater but less than 20% by number and a proportion of the toner particles having an average circularity of less than 0.70 in all of the toner particles is 10% by number or less.

20 Claims, 3 Drawing Sheets

(51) Int. Cl.
*G03G 9/097* (2006.01)
*G03G 21/18* (2006.01)

(52) U.S. Cl.
CPC ..... *G03G 9/08755* (2013.01); *G03G 9/09783* (2013.01); *G03G 21/1803* (2013.01)

(58) Field of Classification Search
USPC ..... 430/110.3, 110.4
See application file for complete search history.

(56) References Cited

U.S. PATENT DOCUMENTS

| | | | |
|---|---|---|---|
| 2008/0213686 | A1 | 9/2008 | Nagai |
| 2008/0227009 | A1 | 9/2008 | Fuwa et al. |
| 2009/0004590 | A1 | 1/2009 | Yamamoto et al. |
| 2009/0068579 | A1 | 3/2009 | Ogawa et al. |
| 2009/0074467 | A1 | 3/2009 | Seshita et al. |
| 2009/0233218 | A1 | 9/2009 | Ogawa |
| 2010/0119968 | A1 | 5/2010 | Komatsu et al. |
| 2010/0151378 | A1* | 6/2010 | Kozuru ..... G03G 9/0827 430/110.4 |
| 2013/0273465 | A1 | 10/2013 | Tanaka et al. |
| 2016/0327884 | A1 | 11/2016 | Nakajima et al. |

FOREIGN PATENT DOCUMENTS

| | | | |
|---|---|---|---|
| EP | 2653926 | A1 | 10/2013 |
| JP | 2005-107517 | | 4/2005 |
| JP | 2008-096992 | | 4/2008 |
| JP | 2009-008950 | | 1/2009 |
| JP | 2009-085975 | | 4/2009 |
| JP | 2009-103767 | | 5/2009 |

OTHER PUBLICATIONS

Written Opinion dated Apr. 26, 2018 for counterpart International Patent Application No. PCT/JP2018/006323 filed Feb. 21, 2018.

* cited by examiner

[Fig. 1]
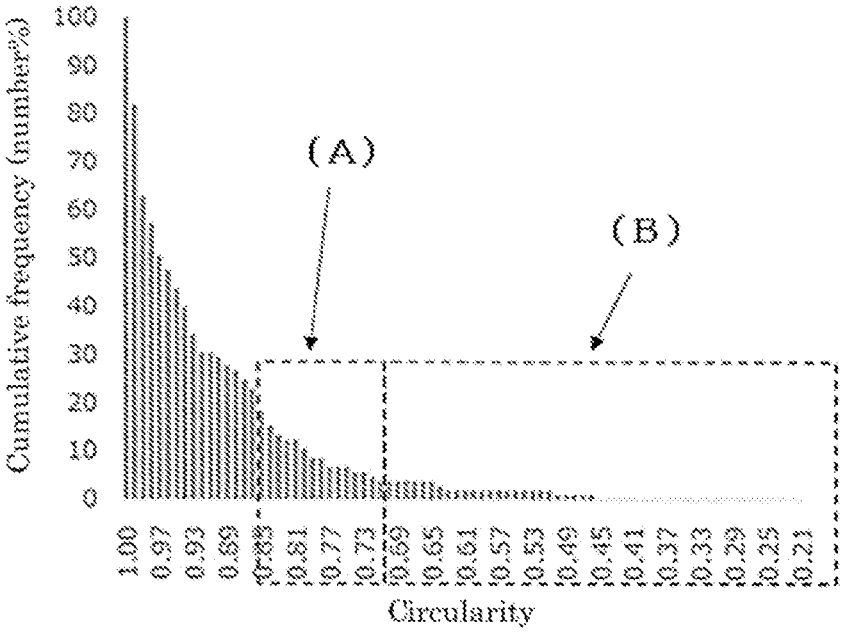
[Fig. 2]
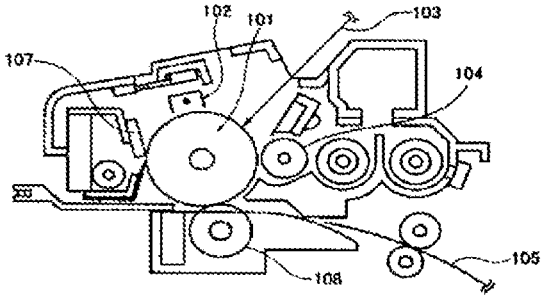
[Fig. 3]
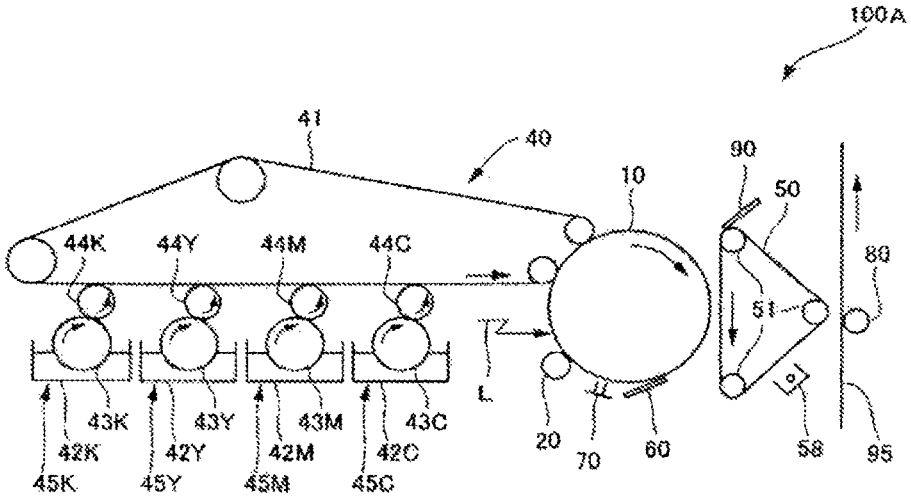

[Fig. 4]
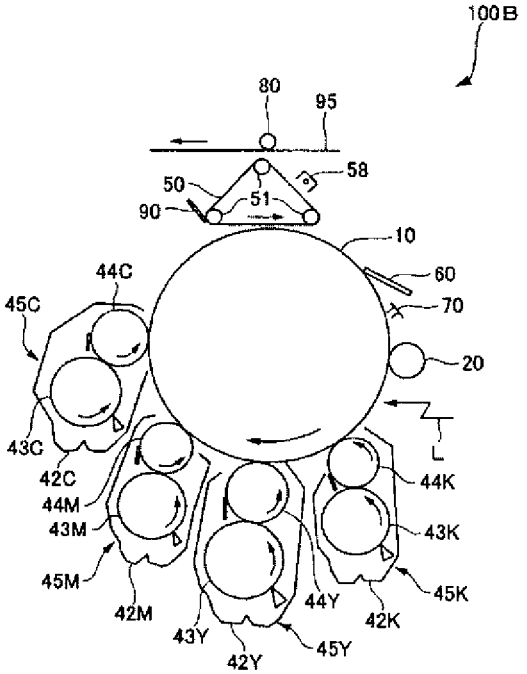
[Fig. 5]
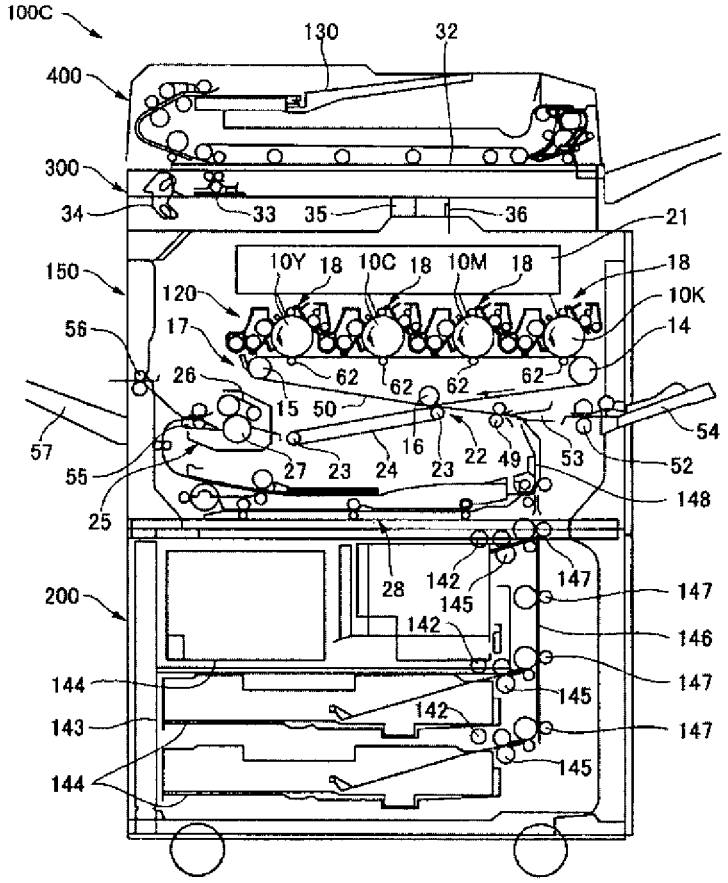

[Fig. 6]
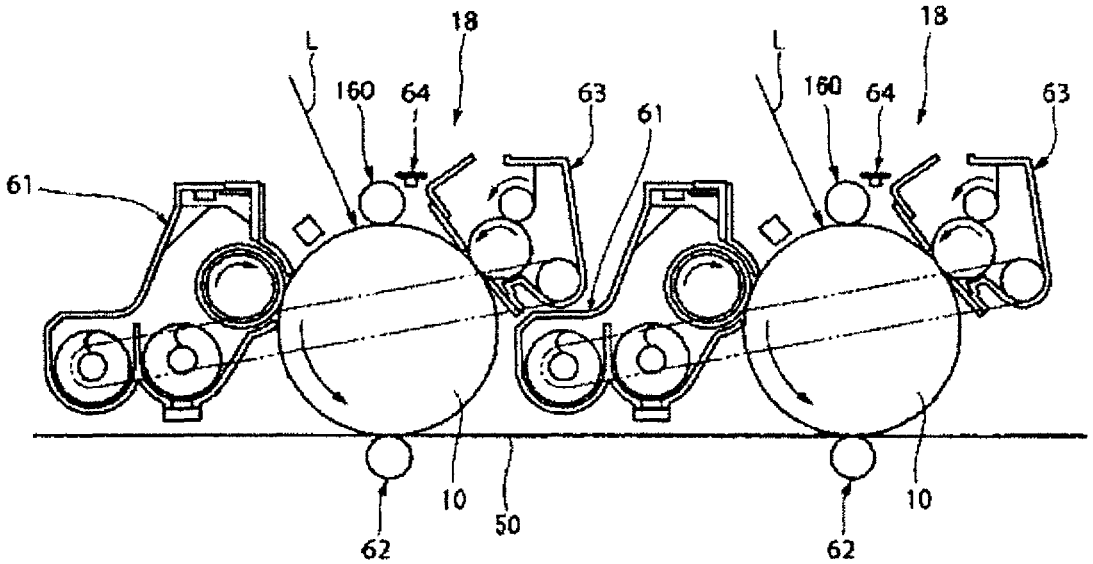

TONER, IMAGE FORMING METHOD, IMAGE FORMING APPARATUS, AND PROCESS CARTRIDGE

TECHNICAL FIELD

The present disclosure relates to a toner, an image forming method, an image forming apparatus, and a process cartridge.

BACKGROUND ART

One-component development is performed by pressing a supply roller etc. against a developing roller to supply a toner on the developing roller, making the toner to be electrostatically held on the developing roller, forming the toner into a thin layer with a regulating blade, friction-charging the toner, and supplying the toner to a photoconductor to develop with the toner. One-component development can realize downsize in weight and cost saving compared to two-component development or magnetic one-component development.

Moreover, sizes of particles of a toner obtained by pulverization have been reduced in order to improve image quality and therefore there is a need for homogeneously disperse a colorant, a charge-controlling agent, or a release agent in a thermoplastic resin. When dispersion is insufficient, the colorant, charge-controlling agent, or release agent added to the toner comes at an outer surface of the toner particle in the process of pulverization. As a result, irregular-shape toner particles having a low average circularity are generated in a very fine powder region having particle diameters of 3 micrometers or smaller. When toner particles are observed per single particle, moreover, there are problems, such as variations in amounts of raw materials contained in the toner particle, and an increase in an amount of the raw materials exposing to a surface of the toner particle. Accordingly, toner-charging failures occur due to unevenness of the toner particles, and problems, such as conveying failures and deterioration in image quality due to background smear, occur.

In order to solve the above-described problems, proposed are to regulate a ratio of toner particles having the low average circularity or an abundance ratio of toner particles having different circularity to a certain range, to control an abundance of toner particles having particle diameters of 4 micrometers or smaller to a certain value or lower, and to control shapes of toner particles in a region of the above-mentioned toner particle diameters.

For example, PTL 1 (Japanese Unexamined Patent Application Publication No. 2005-107517) discloses that an average circularity of toner particles having an equivalent circle diameter of 3.00 micrometers or greater is 0.920 or greater but less than 0.950, a cumulative frequency value of the number of the toner particles having circularity of 0.960 or greater within the toner particles having an equivalent circle diameter of 3.00 micrometers or greater is 40% or less, a cumulative frequency value of the number of the toner particles having circularity of 0.920 or less within the toner particles having an equivalent circle diameter of 3.00 micrometers or greater is 30% or less, and an abundance A (% by number of the toner particles having an equivalent circle diameter of 0.60 micrometers or greater but smaller than 3.00 micrometers relative to all of the toner particles satisfies the following.

$$0.1 \leq A < 15.0 \quad \text{[Math. 1]}$$

PTL 2 (Japanese Unexamined Patent Application Publication No. 2009-85975) discloses a toner including toner particles A a circularity of which is greater than 0.93 but 1.00 or less and toner particles B a circularity of which is 0.85 or greater but 0.93 or less where the toner particles A and the toner particles B satisfy the following relationship.

$$70(\%) \leq (\text{toner particles } A \text{ content in the toner}) \leq 95 \quad \text{[Math. 2]}$$

$$5(\%) \leq (\text{toner particles } B \text{ content in the toner}) \leq 30(\%) \quad \text{[Math. 3]}$$

$$0.014 \leq (\text{standard deviation of circularity of all of the toner particles } A) \leq 0.025 \quad \text{[Math. 4]}$$

$$0.940 \leq (\text{average value of envelopment degree (area) of all of the toner particles } B) \leq 0.950 \quad \text{[Math. 5]}$$

PTL 3 (Japanese Unexamined Patent Application Publication No. 2009-8950) discloses a toner in which first toner particles and second toner particles are mixed, where the first toner particles are obtained by performing classification on pulverized products to remove excessively pulverized toner particles, and the second toner particles include small-particle-diameter particles that have a volume average particle diameter of 1 micrometer or greater but 4 micrometers or smaller and are obtained by performing spheriodizing on the excessively-pulverized toner particles that have a volume average particle diameter smaller than a volume average particle diameter of the first toner particles. Also disclosed are that the particle diameters D50p and D84p at which the cumulative numbers from the large particle size are to be 50% and 84% respectively in a cumulative number distribution as toner particles as a whole, satisfy the following formula (1), that the small-particle-diameter particles included in the second toner particles have an average circularity of 0.940 or greater but 0.960 or less, and that a proportion of irregular-shape particles having circularity of 0.850 or less is 10% by number or less. Moreover, Claim 3 of PTL 3 (Japanese Unexamined Patent Application Publication No. 2009-8950) discloses that the small-particle-diameter particles included in the second toner particles are included in a proportion of 20% by number or greater but 50% by number or less relative to all of the toner particles. [Math. 6]

$$1.43 \leq D50p/D84p \leq 1.64 \quad (1)$$

PTL 4 (Japanese Unexamined Patent Application Publication No. 2009-103767) discloses a toner where the average circularity of toner particles having particle diameters of less than 4 micrometers is 0.940 or greater but 0.960 or less and a ratio of toner particles having particle diameters of less than 4 micrometers and a circularity of 0.850 or less in all of the toner particles is 10% by number or less.

CITATION LIST

Patent Literature

PTL 1: Japanese Unexamined Patent Application Publication No. 2005-107517

PTL 2: Japanese Unexamined Patent Application Publication No. 2009-85975

PTL 3: Japanese Unexamined Patent Application Publication No. 2009-8950

PTL 4: Japanese Unexamined Patent Application Publication No. 2009-103767

SUMMARY OF INVENTION

Technical Problem

The above-described techniques in the art however have a problem that image quality is deteriorated (background smear) due to the presence of irregular-shape toner particles having low circularity. Moreover, there are problems that the toner is adhered to a regulating blade configured to regulate a thickness of a toner layer in a developing unit to thereby cause background smear, and cleaning properties are degraded because circularity of the toner particles is improved.

Accordingly, an object of the present disclosure is to provide a toner that suppresses adherence to a regulating blade, can secure sufficient cleaning properties, can give excellent image quality with less background smear, and has excellent fixing ability.

Solution to Problem

According to one aspect of the present disclosure, a toner includes a binder resin, a release agent, and a charge-controlling agent. The toner includes toner particles having particle diameters of 3 micrometers or smaller. Among the toner particles having particle diameters of 3 micrometers or smaller, a proportion of the toner particles having an average circularity of 0.70 or greater but 0.85 or less in all of the toner particles is 10% by number or greater but less than 20% by number and a proportion of the toner particles having an average circularity of less than 0.70 in all of the toner particles is 10% by number or less.

Advantageous Effects of Invention

The present disclosure can provide a toner that can inhibit adherence to a regulating blade, can give excellent image quality with less background smear, and has excellent fixing ability.

BRIEF DESCRIPTION OF DRAWINGS

FIG. 1 is a schematic graph depicting one example of a cumulative frequency obtained from a circularity measurement of a toner.

FIG. 2 is a view for describing one embodiment of a process cartridge of the present disclosure.

FIG. 3 is a view for describing one embodiment of an image forming apparatus of the present disclosure.

FIG. 4 is a view for describing another embodiment of the image forming apparatus of the present disclosure.

FIG. 5 is a view for describing another embodiment of the image forming apparatus of the present disclosure.

FIG. 6 is a view for describing an image forming unit.

DESCRIPTION OF EMBODIMENTS

Embodiments of a toner, an image forming method, an image forming apparatus, and a process cartridge of the present disclosure will be more specifically described hereinafter.

The present disclosure has characteristics that a proportion of irregular-shape toner particles in a fine powder region where particle diameters are smaller than 3 micrometers is controlled in a certain range.

Specifically, a toner of the present disclosure includes a binder resin, a release agent, and a charge-controlling agent. The toner includes toner particles having particle diameters of 3 micrometers or smaller. Among the toner particles having particle diameters of 3 micrometers or smaller, a proportion of the toner particles having an average circularity of 0.70 or greater but 0.85 or less in all of the toner particles is 10% by number or greater but less than 20% by number and a proportion of the toner particles having an average circularity of less than 0.70 in all of the toner particles is 10% by number or less.

Note that, in the present specification, the proportion of the toner particles having an average circularity of 0.70 or greater but 0.85 or less and the proportion of the toner particles having an average circularity of less than 0.70 are % by number relative to all of the toner particles.

When the proportion of the toner particles having an average circularity of 0.70 or greater but 0.85 or less in all of the toner particles is 20% by number or greater, non-electrostatical adhesion of the toner to an electrostatic-latent-image bearer, such as a photoconductor, increases. A reason for the increase in the non-electrostatical adhesion is because surface contacts between the photoconductor and the toner particles increase compared to a more spherical toner to thereby increase a contact area between the toner and the photoconductor, and exposed areas of the toner raw materials, such as a release agent and a charge-controlling agent, on surfaces of the toner base particles increase due to uneven deposition of the external additive to the toner base particles. Since the colorant, charge-controlling agent, release agent, etc. added to the toner are exposed as surfaces when pulverized, moreover, a total amount of the raw materials included in each toner particle varies when the irregular-shape toner particles are observed per particle, and an amount of exposed surfaces increase. Therefore, toner-charging failures occur and the release agent is bled out because of non-uniformity of the toner, and therefore a reduction in image quality may occur due to background smear or adherence of the toner to a regulating blade.

Even when the proportion of the toner particles having an average circularity of less than 0.70 in all of the toner particles is greater than 10% by number, moreover, non-electrostatical adhesion of the toner to an electrostatic-latent-image bearer, such as a photoconductor, increases from the above-described reason, toner-charging failures and bleeding out of the release agent occur due to unevenness of the toner, and furthermore, deterioration of image quality occurs due to background smear and adherence of the toner to a regulating blade.

The proportion of the toner particles having an average circularity of less than 0.70 in all of the toner particles is preferably 5% by number or less. Moreover, the proportion of the toner particles having an average circularity of less than 0.70 in all of the toner particles is, for example, 1% by number or greater.

When the proportion of the toner particles having an average circularity of 0.70 or greater but 0.85 or less in all of the toner particles is less than 10% by number, moreover, a problem occurs in cleaning because an average circularity of the toner as a whole improves. Therefore, adherence of the toner to a regulating blade is prevented, sufficient cleaning properties are secured, and excellent image quality with less background smear can be obtained by appropriately setting the proportion of the toner particles having an average circularity of 0.70 or greater but 0.85 or less as described above.

The proportion of the toner particles having an average circularity of 0.70 or greater but 0.85 or less in all of the toner particles is more preferably 10% by number or greater but 15% by number or less.

FIG. 1 is a schematic graph depicting one example of a cumulative frequency obtained by a circularity measurement of the toner. A horizontal axis of FIG. 1 represents an average circularity and a vertical axis represents a cumulative frequency (% by number of toner). (A) in FIG. 1 indicates a toner having an average circularity of 0.70 or greater but 0.85 or less, and an improvement in background smear, inhibition of adherence to a regulating blade, and cleaning properties can be achieved by controlling the abundance ratio. (B) in FIG. 1 indicates a toner having an average circularity of less than 0.70, and an improvement in background smear and inhibition of adherence to a regulating blade can be achieved by controlling the abundance ratio.

Moreover, the toner of the present disclosure preferably includes a tetrahydrofuran (THF)-insoluble component in an amount of 10% by mass through 40% by mass and more preferably in an amount of 30% by mass through 40% by mass.

In a molecular-weight distribution of a THF-soluble component of the toner obtained by gel permeation chromatography (GPC), the toner preferably has a main peak between 10,000 and 16,000, and a molecular weight of a half-value width of the main peak is preferably 60,000 through 90,000.

Within the THF-soluble component of the toner, a component having a molecular weight of 2,000 or less as determined by GPC is preferably from 15.0% by mass through 25.0% by mass and a component having a molecular weight of 100,000 or greater as determined by GPC is preferably 10.0% by mass or less.

Since the THF-insoluble component is included in an amount of 10% by mass or greater, deterioration of fixing ability and chipping or cracking of the toner during pulverization or printing can be prevented, generation of irregular-shape toner particles having a low circularity in a very fine powder region can be prevented, and therefore background smear or adherence of the toner to a blade can be prevented. Since the THF-insoluble component is included in an amount of 40% by mass or less, low-temperature fixing ability can be improved.

Since the main peak is 10,000 or greater in the molecular-weight distribution of the THF-soluble component obtained by GPC, deterioration of fixing ability and chipping or cracking of the toner during pulverization or printing can be prevented, generation of irregular-shape toner particles having a low circularity in a very fine powder region can be prevented, and therefore background smear or adherence of the toner to a blade can be prevented. Since the main peak is 16,000 or less, low-temperature fixing ability can be improved.

Since a half-value width of the main peak is a molecular weight of 60,000 or greater, moreover, chipping or cracking of the toner during pulverization or printing can be prevented, dispersibility of the charge-controlling agent or the release agent is improved, and background smear caused by low charging, adherence of the toner to a regulating blade, or filming of the toner onto the photoconductor can be prevented. Moreover, generation of irregular-shape toner particles having a low circularity in a very fine powder region can be prevented, and background smear or adherence of the toner to a blade can be prevented. Since a half-value width of the main peak is a molecular weight of 90,000 or less, low-temperature fixing ability is improved. Since a component having a molecular weight of 2,000 or less as determined by GPC is from 15% by mass through 25% by mass and a component having a molecular weight of 100,000 or greater as determined by GPC is 10.0% by mass or less within the THF-soluble component of the toner, low-temperature fixing ability is improved.

Moreover, in the toner of the present disclosure, a surface-exposed ratio of the charge-controlling agent relative to the binder resin is preferably 0.02% through 0.07% and more preferably 0.02% through 0.05%.

Since the surface-exposed ratio is 0.07% or less, chipping or cracking of the toner during pulverization or printing can be prevented, hence adhesion of the resin, wax, charge-controlling agent, etc. present on the cracked surface to a regulating blade or a photoconductor can be prevented, and occurrences of adherence of the toner to a blade or filming of the toner to a photoconductor can be prevented. Moreover, background smear caused by charging failures can be prevented.

Since the surface-exposed ratio is 0.02% or greater, an original function as the charge-controlling agent can be exhibited, and toner-conveying failures during printing or background smear due to charging failures can be prevented.

Moreover, in the toner of the present disclosure, the surface-exposed ratio of the release agent to the binder resin is preferably 0.02% through 0.10% and more preferably 0.02% through 0.06%.

Since the surface-exposed ratio is 0.10% or less, the release agent present on the surface is unlikely to adhere to a regulating blade or a photoconductor, thus occurrences of adherence to a blade or filming on a photoconductor can be prevented.

Since the surface-exposed ratio is 0.02% or greater, an original function as a release agent can be exhibited, cold offset or deterioration of low-temperature fixing during printing can be prevented.

Next, materials used for the toner of the present disclosure will be described.

A binder resin for use in the present disclosure is not particularly limited, but the binder resin is preferably a polyester resin. The polyester resin is typically obtained through condensation polymerization between alcohol and carboxylic acid. Examples of the alcohol include: glycols, such as ethylene glycol, diethylene glycol, triethylene glycol, and propylene glycol; etherified bisphenols, such as 1,4-bis(hydroxymethyl)cyclohexane and bisphenol A; other divalent alcohol monomers; and trivalent or higher polyvalent alcohol monomers.

Moreover, examples of the carboxylic acid include: divalent organic acid monomers, such as maleic acid, fumaric acid, phthalic acid, isophthalic acid, terephthalic acid, succinic acid, and malonic acid; and trivalent or higher polyvalent carboxylic acid monomers, such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

In view of thermal storage stability, the polyester resin is preferably a polyester resin having glass transition temperature Tg of 55 degrees Celsius or higher, more preferably a polyester resin having glass transition temperature Tg of 60 degrees Celsius or higher.

In view of pulverization, moreover, it is preferable that the toner include a tetrahydrofuran (THF) insoluble component in an amount of 10% by mass through 40% by mass, preferably 30% by mass through 40% by mass, a molecular weight distribution of a THF-soluble component of the toner as measured by gel permeation chromatography (GPC) have a main peak between 10,000 and 16,000, a half-value width of the main peak is 60,000 through 90,000, and within the THF-soluble component of the toner, a component having a molecular weight of 2,000 or less as determined by GPC is from 15.0% by mass through 25.0% by mass and a component having a molecular weight of 100,000 or greater as determined by GPC is 10.0% by mass or less.

As described above, the polyester resin is preferably used as a resin component in the toner. Other resins may be used in combination as long as such resins do not adversely affect performance of the toner.

Examples of usable resins other than the polyester resin include the following resins. Namely, examples of the usable resins include: styrene-based resins (homopolymers or copolymers including styrene or styrene substituents) such as polystyrene, chloropolystyrene, poly-alpha-methylstyrene, styrene/chlorostyrene copolymers, styrene/propylene copolymers, styrene/butadiene copolymers, styrene/vinyl chloride copolymers, styrene/vinyl acetate copolymers, styrene/maleic acid copolymers, styrene/acrylic acid ester copolymers (e.g., styrene/methyl acrylate copolymers, styrene/ethyl acrylate copolymers, styrene/butyl acrylate copolymers, styrene/octyl acrylate copolymers, and styrene/phenyl acrylate copolymers), styrene/methacrylic acid ester copolymers (e.g., styrene/methyl methacrylate copolymers, styrene/ethyl methacrylate copolymers, styrene/butyl methacrylate copolymers, and styrene/phenyl methacrylate copolymers), styrene/methyl alpha-chloroacrylate copolymers, and styrene/acrylonitrile/acrylic acid ester copolymers; vinyl chloride resins; styrene/vinyl acetate copolymers; rosin-modified maleic acid resins; phenol resins; epoxy resins; polyethylene resins; polypropylene resins; ionomer resins; polyurethane resins; silicone resins; ketone resins; ethylene/ethylacrylate copolymers; xylene resins; polyvinyl butyral resins; petroleum-based resins; and hydrogenated petroleum-based resins.

Production methods of the above-listed resins are not particularly limited, any of bulk polymerization, solution polymerization, emulsion polymerization, or suspension polymerization can be used.

Similarly to the polyester resin, moreover, glass transition temperature Tg of any of the resins above is preferably 55 degrees Celsius or higher and more preferably 60 degrees Celsius or higher, in view of thermal storage stability.

As a release agent for use in the toner of the present disclosure, any release agents known in the art can be used. Particularly, free fatty-acid carnauba wax, montan wax, and oxidized rice wax can be used alone or in combination.

The carnauba wax is suitably microcrystalline carnauba wax. The carnauba was is preferably carnauba wax having an acid value of 5 or less and gives particle diameters of 1 micrometer or smaller when the carnauba wax is dispersed in a toner binder.

The montan wax means montan-based wax typically refined from minerals. Similarly to the carnauba wax, the montan wax is preferably microcrystalline and preferably has an acid value of 5 through 14.

The oxidized rice wax is wax obtained by oxidizing rice bran wax in the air and preferably has an acid value of 10 through 30.

As other release agents, any of release agents known in the art, such as solid silicone varnish, higher fatty acid higher alcohol, montan-based ester wax, and low-molecular-weight polypropylene wax, can be used in combination.

An amount of the release agent(s) is, for example, 1 part by mass through 20 parts by mass and more preferably 2 parts by mass through 10 parts by mass relative to 100 parts by mass of the binder resin.

As a charge-controlling agent for use in the present disclosure, any charge-controlling agents known in the art, such as nigrosine dyes, metal complex salt dyes, and salicylic acid metal complexes, can be used alone or in combination. The charge-controlling agent is preferably a metal complex having trivalent or higher metal that may have a 6-coordination structure. Examples of the metal include Al, Fe, Cr, and Zr. Among the above-listed examples, a metal complex having Fe as a central metal is preferable. Fe is not toxic. In the present disclosure, an amount of the charge-controlling agent is preferably 0.5 parts by mass or greater but 3.0 parts by mass or less relative to 100 parts by mass of the binder resin. When the amount of the charge-controlling agent is less than 0.5 parts by mass, a function of the charge-controlling agent is not sufficiently exhibited. When the amount of the charge-controlling agent is greater than 3.0 parts by mass, grindability of the toner is affected, hence blade adherence or filming on a photoconductor may be caused. Moreover, charging failures may be caused, and such a charging failure may be a cause for low image quality, such as toner supply failures and background smear. A more preferably amount of the charge-controlling agent is 0.5 parts by mass or greater but 2.0 parts by mass or less relative to 100 parts by mass of the binder resin.

The charge-controlling agent for use in the present disclosure is preferably azo-iron dyes represented by Structural Formula (1) below and/or Structural Formula (2) below.

[Chem. 1]

Structural Formula (1)

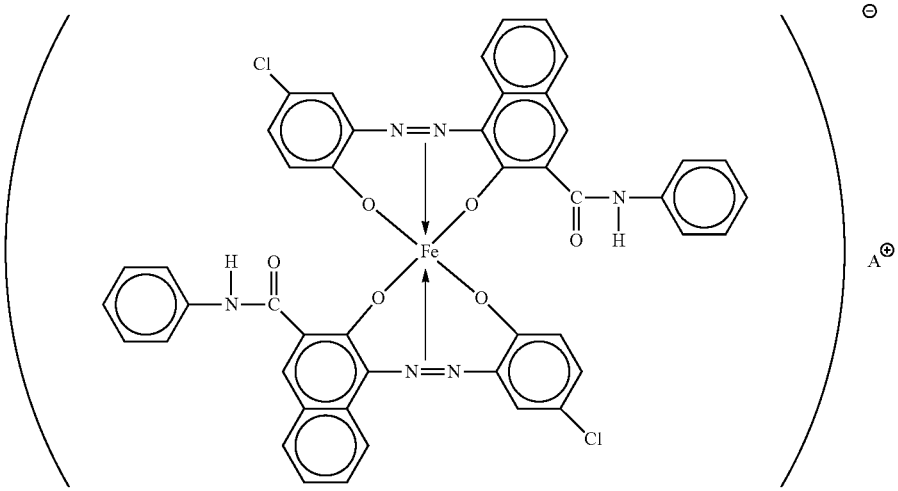

In Structural Formula (1), $A^+$ is an ammonium ion.

[Chem. 2]

Structural Formula (2)

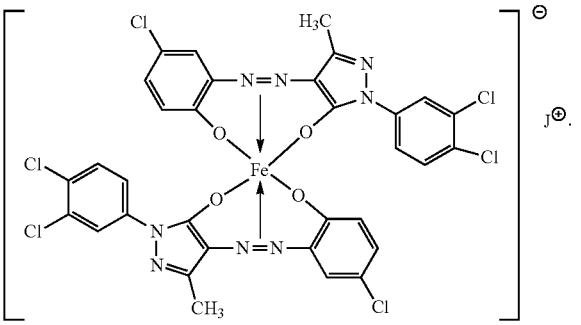

In Structural Formula (2), $J^+$ is an alkali metal cation, an ammonium ion, an alkyl ammonium ion, or a mixture of two or more of the above-listed ions.

Among the above-listed examples, the azo iron dye represented by Structural Formula (1) having appropriate charging ability and a high effect of improving background smear is preferably used.

The azo iron dye represented by Structural Formula (1) is available as T-77 and the azo iron dye represented by Structural Formula (2) is available as T-159 from Hodogaya Chemical Co., Ltd.

Examples of other preferable charge-controlling agents include zirconium salicylates. Zirconium salicylates are available from Hodogaya Chemical Co., Ltd.

As a colorant for use in the toner of the present disclosure, any dyes and pigments known in the art can be used alone or in combination. Examples of the dyes and pigments include carbon black, lamp black, iron black, aniline blue, phthalocyanine blue, phthalocyanine green, Hanza Yellow G, Rhodamine 6C lake, Calco Oil Blue, chrome yellow, quinacridone, benzidine yellow, rose bengal, and triallyl methane-based dyes. The toner can be used as a black color or full-color toners.

An amount of the colorant added is, for example, 1% by mass through 30% by mass and preferably 3% by mass through 20% by mass relative to the binder resin.

Various additives can be used for the toner of the present disclosure. As a flowability improving agent, for example, any flowability improving agents known in the art can be used alone or in combination. Examples of the flowability improving agent include silicon oxide, titanium oxide, silicon carbide, aluminium oxide, and barium titanate.

An amount of the flowability-improving agent for use is, for example, 0.1 parts by mass through 5 parts by mass and preferably 0.5 parts by mass through 2 parts by mass relative to 100 parts by mass of the toner.

<Physical Properties Measuring Methods>

The above-mentioned various physical properties are measured in the following manner.

—Volume Average Particle Diameter—

A measurement is performed by means of a particle-size analyzer ("Multisizer III," available from Beckman Coulter, Inc.) with an aperture diameter of 50 micrometers. After measuring the volume and number of toner particles, a volume distribution and a number distribution are calculated. A volume average particle diameter can be determined from the obtained distribution.

—Measurement of Fine Powder Amount and Average Circularity—

A proportion (% by number) of toner particles having an average circularity of 0.70 or greater but 0.85 or less in all of the toner particles and a proportion (% by number) of toner particles having an average circularity of less than 0.70 in all of the toner particles among toner particles having particle diameters of 3 micrometers or smaller can be measured by means of FPIA-3000 (available from SYSMEX CORPORATION).

A measurement method of shapes is preferably an optical-detection zone method where a suspension liquid including a toner is passed through a detection zone of an imaging unit on a flat plate, an image of particles is optically detected by a CCD camera to analyze shapes of toner particles. A value obtained by dividing perimeters of equivalent circles having the identical projected area determined by the above-mentioned method by perimeters of actual particles is an average circularity.

Note that, FPIA-3000 (available from SYSMEX CORPORATION) measures shapes from the image, thus particle diameters and circularity of the toner particles can be measured at the same time. By means of FPIA-3000 (available from SYSMEX CORPORATION), therefore, among the toner particles having particle diameters of 3 micrometers or smaller, the proportion (% by number) of the toner particles having an average circularity of 0.70 or greater but 0.85 or less in all of the toner particles and the proportion (% by number) of the toner particles having an average circularity of less than 0.70 in all of the toner particles can be determined.

A specific measurement method is as follows. Into 100 mL through 150 mL of water from which impurity solids have been removed in a container, 0.1 mL through 0.5 mL of a surfactant, preferably alkylbenzene sulfonic acid salt, is added as a dispersing agent and a measuring sample is further added in an amount of about 0.1 g through about 0.5 g. A suspension liquid in which the sample is dispersed is subjected to a dispersion treatment for about 1 minute through about 3 minutes by means of an ultrasonic disperser to prepare a dispersion liquid having a concentration of 3,000 particles/microliter through 10,000 particles/microliter. The dispersion liquid is then subjected to measurements of shapes and a distribution of toner particles by means of the above-mentioned device.

—Molecular Weight Measurement (GPC)—

A molecular weight is measured by gel permeation chromatography (GPC) under the following conditions.

Device: GPC-150C (available from WATERS)

Column: KF801 to 807 (available from SHODEX)

Temperature: 40 degrees Celsius

Solvent: tetrahydrofuran (THF)

Flow rate: 1.0 mL/min

Sample: A sample having a concentration of 0.05% through 0.6% in an amount of 0.1 mL is injected.

A number average molecular weight and a weight average molecular weight of the resin are calculated from a molecular weight distribution of the resin measured under the above-described conditions using a molecular-weight calibration curve prepared from monodisperse polystyrene standard samples.

As for the polystyrene standard samples for preparing the calibration curve, Showdex STANDARD Std. Nos. S-7300, S-210, S-390, S-875, S-1980, S-10.9, S-629, S-3.0, and S-0.580 available from SHOWA DENKO K.K. and toluene are used. As the detector, a refractive index (RI) detector is used.

—THF-Soluble Component and THF-Insoluble Component—

A toner is weighed by about 50 mg. To the toner, 10 g of THF is added to prepare a sufficiently dissolved toner solution. After separating through centrifugation, a supernatant liquid is dried and a solid content of the supernant liquid is calculated. The result is determined as a THF-soluble component. The value obtained by subtracting the THF-soluble component from a solid content of the entire toner is determined as a THF-insoluble component.

—Surface-Exposed Ratio of Charge-Controlling Agent—

The toner (50 mg) is added to 20 g of a 90% ethanol aqueous solution and the resultant mixture is stirred for 2 minutes followed by applying ultrasonic waves for 5 minutes. The resultant solution is subjected to filtration and the resultant is subjected to a measurement by means of an ultraviolet-visible spectrometer (UV-2550 available from Shimadzu Corporation) with a measurement wavelength range of 200 nm through 400 nm. An amount of the charge-controlling agent in the solution is calculated from the obtained absorbance. When the entire charge-controlling agent present on the surface is dissolved, the value of the amount corresponds to a surface-exposed amount of the charge-controlling agent. Moreover, saturated absorbance can be determined by calculation by performing the above-described measurement of the absorbance over stirring time.

Calculation formulae are as follows.

Charge-controlling agent-exposed amount (wt %) per unit weight of toner=surface-exposed amount (g) of charge-controlling agent/toner weight (g)×100

Surface-exposed ratio (wt %) of charge-controlling agent=surface-exposed amount of charge-controlling agent (g)/amount (g) of charge-controlling agent in toner×100

—Surface-Exposed Ratio of Release Agent—

A measuring method of a surface-exposed ratio of the release agent will be explained.

The surface-exposed ratio of the release agent is measured using a disk of the toner prepared by pressing for 1 minute at 6 ton by measuring a surface of the disk by FT-IR available from PerkinElmer according to the ATR method (using Ge crystal).

With the absorbance, a relative intensity ratio of the peak intensity (wax component) of 2,850 $cm^{-1}$ to the peak intensity (resin component) of 828 $cm^{-1}$ is determined as a surface-exposed ratio of the release agent.

The toner of the present disclosure can be produced by a known production method including a melt-kneading step including kneading toner material with melting, a pulverization step including pulverizing the obtained melt-kneaded product, and a classification step including classifying the pulverized product obtained by the pulverization.

In the melt-kneading, the toner materials are mixed, a melt-kneader is charged with the mixture to perform melt kneading. As the melt-kneader, for example, a single-screw or twin-screw continuous kneader, or a batch-type kneader using a roll mill can be used. For example, KTK twin-screw extruder available from Kobe Steel, Ltd., TEM twin-screw kneader available from TOSHIBA MACHINE CO., LTD., a twin-screw extruder available from KCK, PCM twin-screw extruder available from IKEGAI, and a co-kneader available from BUSS are suitably used. The melt kneading is preferably performed under appropriate conditions not to cut molecular chains of the binder resin. Specifically, the melt-kneading temperature is determined with reference to a softening point of the binder resin. When the melt-kneading temperature is excessively higher than the softening point, chain scission occurs significantly. When the melt-kneading temperature is too low, dispersion may not be progressed.

In the pulverization step, the kneaded product obtained by the kneading is pulverized. In the pulverization, it is preferable that the kneaded product be roughly pulverized first, and then finely pulverized. At the time of the pulverization, a system where pulverization is performed by making the kneaded product crush into an impact board in a jet flow, particles are made crushed with each other in a jet flow to pulverize, or the kneaded product is pulverized with a narrow gap between a mechanically-rotating rotor and a stator.

The classification step is to classify the pulverized product obtained by the pulverization to adjust to particles having the predetermined particle diameters. The classification can be performed by removing fine particle component by a cyclone, a decanter, or a centrifuge separator.

After completing the pulverization step and the classification step, the pulverized product is classified in an air flow by a centrifugal force etc., to thereby produce toner base particles having the predetermined particle diameters. Subsequently, external additives are optionally added to the toner base particles. The toner base particles and the external additives are mixed and stirred by a mixer to cover surfaces of the toner base particles with the external additive while crushing the external additives.

In order to achieve the characteristics of the present disclosure, "among the toner particles having particle diameters of 3 micrometers or smaller, a proportion of the toner particles having an average circularity of 0.70 or greater but 0.85 or less in all of the toner particles is 10% by number or greater but less than 20% by number and a proportion of the toner particles having an average circularity of less than 0.70 in all of the toner particles is 10% by number or less," there is a method where a known spheroidizing step using a turbo mill etc. is performed between the pulverization step and the classification step. Such a method can be appropriately performed by the person skilled in the art.

Typically, one-component development tends to easily apply stress to a toner and therefore the above-described problem of low image quality due to background smear is caused. The toner of the present disclosure can solve the problem of low image quality due to background smear, and therefore the toner is particularly useful as a toner for one-component development.

(Image forming method and image forming apparatus)

An image forming method of the present disclosure includes forming an image by one-component development. The image forming method includes at least an electrostatic latent image-forming step and a developing step, and may further include other steps, such as a charge-eliminating step, a cleaning step, a recycling step, and a controlling step, according to the necessity.

An image forming apparatus of the present disclosure includes at least an electrostatic-latent-image bearer (may be referred to as a "photoconductor" hereinafter), an electrostatic latent image-forming unit configured to form an electrostatic latent image on the photoconductor, and a developing unit configured to develop the electrostatic latent image with a developer including a toner to form a visible image. The image forming apparatus may further include other units, such as a charge-eliminating unit, a cleaning unit, a recycling unit, and a controlling unit, according to the necessity.

The image forming method is preferably performed by the image forming apparatus. The electrostatic latent image-forming step can be preferably performed by the electrostatic latent image-forming unit, the developing step is preferably performed by the developing unit, and the above-mentioned other steps are preferably performed by the above-mentioned other units.

—Electrostatic Latent Image-Forming Step and Electrostatic Latent Image-Forming Unit—

The electrostatic latent image-forming step is a step including forming an electrostatic latent image on an electrostatic-latent-image bearer.

A material, shape, structure, size, etc. of the electrostatic-latent-image bearer (may be also referred to as "electrophotographic photoconductor" or "photoconductor") are not particularly limited and may be appropriately selected from materials, shapes, structures, sizes, etc., known in the art. A preferable example of the shape of the photoconductor is a drum shape. Examples of the material of the photoconductor include: inorganic photoconductors, such as amorphous silicon and selenium, and organic photoconductors (OPC), such as polysilane, and phthalopolymethine. Among the above-listed examples, an organic photoconductor (OPC) is preferable because an image of higher resolution can be obtained.

For example, formation of the electrostatic latent image can be performed by uniformly charging a surface of the electrostatic-latent-image bearer, followed by exposing the surface of the electrostatic-latent-image bearer with light imagewise. The formation of the electrostatic latent image can be performed by an electrostatic latent image-forming unit.

For example, the electrostatic latent image-forming unit includes at least a charging unit (charger) configured to uniformly charge a surface of the electrostatic-latent-image bearer, and an exposing unit (exposure device) configured to expose the surface of the electrostatic-latent-image bearer to light imagewise.

For example, the charging can be performed by applying voltage to a surface of the electrostatic-latent-image bearer using the charger.

The charger is not particularly limited and may be appropriately selected depending on the intended purpose. Examples of the charger include a contact charger, known in the art as itself, equipped with an electroconductive or semiconductive roller, brush, film, or rubber blade, and a non-contact charger utilizing corona discharge, such as corotron, and scorotron.

The charger is preferably a charger that is disposed in contact with or without contact with the electrostatic-latent-image bearer and is configured to superimpose DC voltage and AC voltage to charge a surface of the electrostatic-latent-image bearer.

Moreover, the charger is preferably a charging roller disposed adjacent to the electrostatic-latent-image bearer via a gap tape without being in contact with the electrostatic-latent-image bearer, where a surface of the electrostatic-latent-image bearer is charged by applying superimposed DC and AC voltage to the charging roller.

The exposure can be performed by exposing the surface of the electrostatic-latent-image bearer to light imagewise using the exposure device.

The exposure device is not particularly limited as long as the exposure device can expose a surface of the electrostatic-latent-image bearer charged by the charger to light that is in the shape of an image to be formed. The exposure device may be appropriately selected depending on the intended purpose. Examples of the exposure device includes various exposure devices, such as a reproduction optical exposure device, a rod-lens array exposure device, a laser optical exposure device, and a liquid crystal shutter optical device.

In the present disclosure, a back light system where exposure is performed imagewise from a back side of the electrostatic-latent-image bearer may be employed.

—Developing Step and Developing Unit—

The developing step is a step including developing the electrostatic latent image with the toner to form a visible image.

For example, formation of the visible image can be performed by developing the electrostatic latent image with the toner and can be performed by the developing unit. For example, the developing unit is preferably a developing unit that stores the toner and includes at least a developing device capable of applying the toner to the electrostatic latent image in contact with the electrostatic latent image or without being in contact with the electrostatic latent image. The developing unit is more preferably a developing device equipped with a toner stored container.

The developing device may be a developing device for a single color or a developing device for multiple colors. Preferable examples of the developing device include a developing device including a stirrer configured to stir the toner to cause frictions to charge the toner, and a rotatable magnetic roller.

Inside the developing device, for example, the toner and the carrier are mixed and stirred to cause frictions, the toner is charged by the frictions, and the charged toner is held on a surface of the rotating magnetic roller in the form of a brush to thereby form a magnetic brush. Since the magnet roller is disposed adjacent to the electrostatic-latent-image bearer (photoconductor), part of the toner constituting the magnetic brush formed on the surface of the magnetic roller is transferred onto a surface of the electrostatic-latent-image bearer (photoconductor) by electric suction force. As a result, the electrostatic latent image is developed with the toner to form a visible image formed of the toner on the surface of the electrostatic-latent-image bearer (photoconductor).

—Transferring Step and Transferring Unit—

The transferring step is a step including transferring the visible image to a recording medium. A preferable embodiment of the transferring step is a step using an intermediate transfer member and including primary transferring a visible image onto the intermediate transfer member, followed by secondary transferring the visible image onto the recording medium. A more preferable embodiment of the transferring step is a step using, as the toner, toners of two or more colors, preferably full-color toners, and including a primary transferring step including transferring visible images onto an intermediate transfer member to form a composite transfer image, and a secondary transferring step including transferring the composite transfer image onto a recording medium.

The transfer can be performed by charging the visible image on the electrostatic-latent-image bearer (photoconductor) using a transfer charger. The transfer can be performed by the transfer unit. A preferable embodiment of the transferring unit is a transferring unit including a primary transferring unit configured to transfer visible images onto an intermediate transfer member to form a composite transfer image and a secondary transferring unit configured to transfer the composite transfer image onto a recording medium.

Note that, the intermediate transfer member is not particularly limited and may be appropriately selected from transfer members known in the art depending on the intended purpose. Preferable examples of the intermediate transfer member include a transfer belt.

The transferring unit (the primary transferring unit or the secondary transferring unit) preferably includes at least a transferring device configured to charge the visible image formed on the electrostatic-latent-image bearer (photoconductor) to release the visible image to the side of the recording medium. The number of the transferring device disposed may be one, or 2 or more.

Examples of the transferring device include a corona transfer device using corona discharge, a transfer belt, a transfer roller, a pressure-transfer roller, and an adhesion-transfer device.

Note that, the recording medium is not particularly limited and may be appropriately selected from recording media (recording paper) known in the art.

—Fixing Step and Fixing Unit—

The fixing step is a step including fixing the transferred visible image onto the recording medium using a fixing device. The fixing step may be performed every time when the developer of each color is transferred onto the recording medium, or may be performed once when the developers of all colors are laminated.

The fixing device is not particularly limited and may be appropriately selected depending on the intended purpose. The fixing device is preferably a heat-press unit. Examples of the heat-press unit include a combination of a heating roller and a press roller, and a combination of a heat roller, a press roller, and an endless belt.

The fixing device is preferably a unit that includes a heating body equipped with a heat generator, a film in contact with the heating body, and a press member pressed against the heating body via the film, and is configured to pass a recording medium on which an unfixed image is formed through between the film and the press member to heat-fixing the image onto the recording medium. Heating performed by the heat-press unit is generally performed at 80 degrees Celsius through 200 degrees Celsius.

In the present disclosure, in combination with or instead of the fixing step and the fixing unit, for example, a photofixing device known in the art may be used depending on the intended purpose.

—Other Steps and Other Units—

The charge-eliminating step is a step including applying charge-elimination bias to the electrostatic-latent-image bearer to eliminate the charge of the electrostatic-latent-image bearer. The charge-eliminating step is preferably performed by a charge-eliminating unit.

The charge-eliminating unit is not particularly limited as long as the charge-eliminating unit is capable of applying charge-elimination bias to the electrostatic-latent-image bearer. The charge-eliminating unit may be appropriately selected from charge eliminators known in the art. Examples of the charge-eliminating unit include charge-eliminating lamps.

The cleaning step is a step including removing the toner remained on the electrostatic-latent-image bearer. The cleaning step is preferably performed by a cleaning unit.

The cleaning unit is not particularly limited as long as the cleaning unit is capable of removing the toner remained on the electrostatic-latent-image bearer. The cleaning unit is appropriately selected from cleaners known in the art. Preferable examples of the cleaner include magnetic-brush cleaners, electrostatic-brush cleaners, magnetic-roller cleaners, blade cleaners, brush cleaners, and web cleaners.

The recycling step is a step including recycling the toner removed by the cleaning step to the developing unit. The recycling unit is preferably performed by a recycling unit. The recycling unit is not particularly limited. Examples of the recycling unit include conveying units known in the art.

The controlling step is a step including controlling each of the above-described steps. The controlling step is preferably performed by the controlling unit.

The controlling unit is not particularly limited as long as the controlling unit is capable of controlling operations of each of the above-mentioned units. The controlling unit may be appropriately selected depending on the intended purpose. Examples of the controlling unit include devices, such as sequencers and computers.

A first example of the image forming apparatus of the present disclosure is illustrated in FIG. 3. An image forming apparatus 100A includes a photoconductor drum 10, a charging roller 20, an exposing device, a developing device 40, an intermediate transfer belt 50, a cleaning device 60 including a cleaning blade, and a charge-eliminating lamp 70.

The intermediate transfer belt 50 is an endless belt that is supported with three rollers 51 disposed at the inner side of the intermediate transfer belt 50. The intermediate transfer belt 50 can be moved in the direction indicated with an arrow in FIG. 3. Part of the three rollers 51 also functions as a transfer bias roller capable of applying transfer bias (primary transfer bias) to an intermediate transfer belt 50. Moreover, a cleaning device 90 having a cleaning blade is disposed adjacent to the intermediate transfer belt 50. Furthermore, a transfer roller 80 is disposed to face the intermediate transfer belt 50. The transfer roller is capable of applying transfer bias (secondary transfer bias) for transferring a toner image to transfer paper 95.

In the surrounding area of the intermediate transfer belt 50, a corona-charging device 58 configured to apply charge to the toner image transferred to the intermediate transfer belt 50 is disposed between a contact area of the photoconductor drum 10 and the intermediate transfer belt 50 and a contact area of the intermediate transfer belt 50 and the transfer paper 95 relative to a rotational direction of the intermediate transfer belt 50.

The developing device 40 includes a developing belt 41, and a black-developing unit 45K, a yellow-developing unit 45Y, a magenta-developing unit 45M, and a cyan-developing unit 45C disposed in the surrounding area of the developing belt 41. Note that, the developing unit of each color includes a developer stored unit 42K, 42Y, 42M, or 42C, a developer-supply roller 43K, 43Y, 43M, or 43C, and a developing roller (developer bearer) 44K, 44Y, 44M, or 44C. Moreover, the developing belt 41 is an endless belt supported by a plurality of belt rollers and is rotatable in the direction indicated with the arrow in FIG. 3. Moreover, part of the developing belt 41 is in contact with the photoconductor drum 10.

Next, a method for forming an image using the image forming apparatus 100A will be explained. First, a surface of the photoconductor drum 10 is uniformly charged using the charging roller 20, followed by applying exposure light L to the photoconductor drum 10 using an exposing device (not illustrated) to form an electrostatic latent image. Next, the electrostatic latent image forming on the photoconductor drum 10 is developed with a toner supplied from the developing device 40 to form a toner image. Moreover, the toner image formed on the photoconductor drum 10 is transferred (primary transfer) onto the intermediate transfer belt 50 by transfer bias applied from the roller 51, transferring the toner image (secondary transfer) onto transfer paper 95 by transfer bias applied from the transfer roller 80. Meanwhile, the toner remained on a surface of the photoconductor drum 10, from which the toner image has been transferred to the intermediate transfer belt 50, is removed by the cleaning device 60, followed by eliminating the charge from the surface using the charge-eliminating lamp 70.

A second example of the image forming apparatus for use in the present disclosure is illustrated in FIG. 4. The image forming apparatus 100B has the same structure to the structure of the image forming apparatus 100A, except that the developing belt 41 is not disposed, and the black-developing unit 45K, the yellow-developing unit 45Y, the magenta-developing unit 45M, and the cyan-developing unit 45C are disposed directly facing the perimeter of the photoconductor drum 10.

A third example of the image forming apparatus for use in the present disclosure is illustrated in FIG. 5. An image forming apparatus 100C is a tandem color-image forming apparatus and includes a photocopier main body 150, a paper-feeding table 200, a scanner 300, and an automatic document feeder (ADF) 400.

An intermediate transfer belt 50 disposed in a central area of the photocopier main body 150 is an endless belt supported by three rollers 14, 15, and 16. The intermediate transfer belt 50 can be rotated in the direction indicated with the arrow in FIG. 5. A cleaning device 17 having a cleaning blade configured to remove a toner remained on the intermediate transfer belt 50, from which a toner image has been transferred to recording paper, is disposed adjacent to the roller 15. A yellow-image forming unit 10Y, a cyan-image forming unit 10C, a magenta-image forming unit 10M, and a black-image forming unit 10K are disposed parallel along the conveying direction, as well as facing the intermediate transfer belt 50 supported by the rollers 14 and 15.

Moreover, an exposing device 21 is disposed adjacent to the image forming unit 120. Furthermore, a secondary-transfer belt 24 is disposed at the side of the intermediate transfer belt 50 opposite to the side where the image forming unit 120 is disposed. Note that, the secondary-transfer belt 24 is an endless belt supported by a pair of rollers 23, and recording paper transported on the secondary-transfer belt 24 and the intermediate transfer belt 50 can be brought into contact with each other between the rollers 16 and 23.

Moreover, a fixing device 25 is disposed adjacent to the secondary-transfer belt 24. The fixing device 25 includes a fixing belt 26 that is an endless belt supported by a pair of rollers, and a press roller 27 disposed to be pressed against the fixing belt 26. Note that, a sheet reverser 28 configured to reverse recording paper when images are formed on both sides of the recording paper is disposed adjacent to the secondary-transfer belt 24 and the fixing device 25. The reference numeral 22 represents a secondary transferring device.

Next, a method for forming a full-color image using the image forming apparatus 100C will be explained. First, a color document is set on a document table 130 of the automatic document feeder (ADF) 400. Alternatively, the automatic document feeder 400 is opened, a color document is set on a contact glass 32 of a scanner 300 and then the automatic document feeder 400 is closed. In the case where the document is set on the automatic document feeder 400, once a start switch, which is not illustrated, is pressed, the document is transported onto the contact glass 32, and then the scanner 300 is driven to scan the document with a first carriage 33 equipped with a light source and a second carriage 34 equipped with a minor. In the case where the document is set on the contact glass 32, the scanner 300 is immediately driven in the same manner as mentioned. Light is emitted from the first carriage 33 is reflected from a surface of the document and the reflected light is reflected by the second carriage 34, and then the reflected light is received by a reading sensor 36 via an image forming lens 35 to read the document to thereby obtain image information of black, yellow, magenta, and cyan.

Image information of each color is transmitted to a corresponding image-forming unit 18 of a corresponding image forming unit 120 to form a toner image of each color. As illustrated in FIG. 6, the image forming unit 120 of each color includes a photoconductor drum 10, a charging roller 160 configured to uniformly charge the photoconductor drum 10, an exposing device configured to apply exposure light L to the photoconductor drum 10 based on the image information of each color to form an electrostatic latent image of each color, a developing device 61 configured to develop the electrostatic latent image with a developer of each color to form a toner image of each color, a transfer roller 62 configured to transfer the toner image onto the intermediate transfer belt 50, a cleaning device 63 having a cleaning blade, and a charge-eliminating lamp 64.

The single-color toner images formed by the image forming units 120 of the above-mentioned colors are sequentially transferred (primary transfer) onto the intermediate transfer belt 50 moving with being supported by the rollers 14, 15, and 16 to superimpose the single-color toner images to thereby form a composite toner image. Meanwhile, one of paper feeding rollers 142 of the paper feeding table 200 is selectively rotated to feed sheets from one of vertically stacked paper feeding cassette 144 housed in a paper bank 143. The sheets are separated one another by a separation roller 145. The separated sheet is fed through a paper feeding path 146, then fed through a paper feeding path 148 in the photocopier main body 150 by conveying with a conveyance roller 147, and is stopped at a registration roller 49. Alternatively, paper feeding rollers are rotated to feed sheets on a bypass feeder 54. The sheets are separated one another by a separation roller 52. The separated sheet is fed through a manual paper feeding path 53, and is stopped at the registration roller 49.

Note that, the registration roller 49 is generally earthed at the time of use, but the registration roller 49 may be used in a state where bias is applied in order to remove paper dusts of recording paper. Next, the registration roller 49 is rotated to synchronously with the movement of the composite toner image formed on the intermediate transfer belt 50, to thereby send the recording paper between the intermediate transfer belt 50 and the secondary-transfer belt 24. The composite toner image is transferred (secondary transfer) on the recording paper. Note that, the toner remained on the intermediate transfer belt 50, from which the composite toner image has been transferred, is removed by the cleaning device 17.

The recording paper, onto which the composite toner image has been transferred, is conveyed by the secondary-transfer belt 24 and then the composite toner image is fixed by the fixing device 25. Next, the traveling path of the recording paper is changed by a switch craw 55 and the recording paper is ejected onto a paper-ejection tray 57 by an ejecting roller 56. Alternatively, the traveling path of the recording paper is changed by the switch craw 55 and the recording paper is reversed by the sheet reverser 28. After forming an image on a back side of the recording paper in the same manner, the recording paper is ejected onto the paper-ejection tray 57 by the ejection roller 56.

In the present disclosure, a toner stored unit is a unit that has a function of storing a toner and stores the toner therein. Examples of an embodiment of the toner stored unit include a toner stored container, a developing device, and a process cartridge.

The toner stored container is a container that stores a toner.

The developing device is a developing device including a developing unit storing a toner.

The process cartridge includes at least an electrostatic-latent-image bearer and a developing unit configured to develop an electrostatic latent image formed on the electrostatic-latent-image bearer with a developer to form a visible image. The process cartridge is detachably mounted in a main body of an image forming apparatus. The above-mentioned developer is the toner of the present disclosure. The process cartridge may further includes at least one selected from the group consisting of a charging unit, an exposing unit, and a cleaning unit.

Next, one embodiment of the process cartridge is illustrated in FIG. 2. As illustrated in FIG. 2, the process cartridge of the present embodiment includes an electrostatic-latent-image bearer 101 inside the process cartridge, includes a charging device 102, a developing device 104, and a cleaning unit 107, and may further include other units according to the necessity. In FIG. 2, the reference numeral 103 represents exposure from the exposing device and the reference numeral 105 represents recording paper.

As the electrostatic-latent-image bearer 101, a similar electrostatic-latent-image bearer to the one used in the above-described image forming apparatus can be used. Moreover, an arbitrary charging member is used for the charging device 102.

An image forming process performed by the process cartridge illustrated in FIG. 2 is as follows. While the electrostatic-latent-image bearer 101 is rotated clockwise, an electrostatic latent image corresponding to an exposure image is formed on a surface of the electrostatic-latent-image bearer 101 by performing charging by the charging device 102 and exposure 103 by an exposing unit (not illustrated).

The electrostatic latent image is developed with a toner by the developing device 104, and the toner-developed image is transferred onto recording paper 105 by the transfer roller 108, followed by printing out the recording paper. Subsequently, a surface of the electrostatic-latent-image bearer after the image transfer is cleaned by the cleaning unit 107. Moreover, the charge of the surface of the electrostatic-latent-image bearer is eliminated by a charge-eliminating unit (not illustrated), and then the above-described operation of the image forming process is again repeated.

Since image formation is performed using the toner of the present disclosure by mounting the toner stored unit storing the toner of the present disclosure in the image forming apparatus, adhesion of the toner to a regulating blade is inhibited, cleaning properties are sufficiently secured, and excellent image quality without background smear can be obtained.

EXAMPLES

The present disclosure will be described in more detail by way of the following Examples. However, the present disclosure should not be construed as being limited to these Examples. Note that, "part(s)" mentioned in each Examples or Comparative Example denotes "part(s) by mass" unless otherwise stated.

<Production of Polyester>

A four-necked recovery flask that had a volume of 1 L and was equipped with a thermometer, a stirrer, a condenser, and a nitrogen gas-inlet tube was charged with an acid component and an alcohol component presented in Tables 1 and 2. The flask was set in a heating mantle and the flask was heated in a state where nitrogen gas was introduced into the flask through the nitrogen gas-inlet tube to maintain the inner atmosphere of the flask an inert atmosphere. Subsequently, 0.05 parts by mass of dibutyl tin oxide was added and the mixture inside the flask was allowed to react with maintaining the temperature to 200 degrees Celsius to thereby obtain each polyester. Various physical properties of each polyester are also presented in Tables 1 and 2. Note that, in Tables 1 and 2, the numerical values for the acid component and the alcohol component are represented by "part(s) by mass," "Mw" denotes a weight average molecular weight, and the numerical values for the THF-insoluble component are presented by "%." Moreover, the numerical value of "peak-top molecular weight" is a main peak value of the molecular weight.

TABLE 1

| Polyester resin A | | Resin A-1 | Resin A-2 | Resin A-3 |
|---|---|---|---|---|
| Acid component | terephthalic acid | 25 | 35 | 15 |
| | fumaric acid | 30 | 10 | 20 |
| | succinic acid | | 5 | 15 |
| Alcohol component | bisphenol A(2.2) propylene oxide | 25 | 15 | 35 |
| | bisphenol A (2.2) ethylene oxide | 20 | 35 | 15 |
| Physical properties | Mw | 36,000 | 32,000 | 42,500 |
| | peak-top molecular weight | 13,000 | 9,000 | 11,000 |
| | THF-insoluble component | 0 | 0 | 0 |

TABLE 2

| Polyester resin B | | Resin B-1 | Resin B-2 | Resin B-3 | Resin B-4 |
|---|---|---|---|---|---|
| Acid component | terephthalic acid | 20 | 15 | 10 | 10 |
| | fumaric acid | | 15 | 30 | 15 |
| | succinic acid | | | | 18 |
| | trimellitic acid | 30 | 20 | 15 | 7 |
| Alcohol component | bisphenol A(2.2) propylene oxide | 15 | 35 | 40 | 20 |
| | bisphenol A (2.2) ethylene oxide | 85 | 15 | 10 | 30 |
| Physical properties | Mw | 40,000 | 38,000 | 80,000 | 72,000 |
| | peak-top molecular weight | 18,000 | 13,000 | 16,200 | 9,500 |
| | THF-insoluble component | 38 | 27 | 25 | 13 |

Example 1

After stirring and mixing a mixture having a composition below for 5 min at rotational speed of 3,000 rpm by means of Henschel Mixer (FM20B, available from NIPPON COKE & ENGINEERING CO., LTD.), the resultant mixture was melt-kneaded at rotational speed of 600 rpm by means of a twin-screw extrusion kneader (TEM-18SS, available from TOSHIBA MACHINE CO., LTD.) at barrel temperature of from 100 degrees Celsius through 160 degrees Celsius. The obtained kneaded product was rolled to a thickness of 1.7 mm by a roller, followed by cooling the rolled product to room temperature. Thereafter, the rolled product was pulverized and classified by means of a jet mill (IDS-2, available from NIPPON PNEUMATIC MFG. CO., LTD.) and a rotor classifier (100TTSP, available from HOSOKAWA MICRON CORPORATION), to thereby obtain toner base particles having a volume average particle diameter of 8 micrometers, where among the toner particles having particle diameters of 3 micrometers or smaller, a proportion of toner particles having an average circularity of 0.70 or greater but 0.85 or less in all of the toner particles was 15.8% by number and a proportion of toner particles having an average circularity of less than 0.70 in all of the toner particles was 2.8% by number.

—Composition—

Polyester resin A-1: 50 parts

Polyester resin B-1: 50 parts

Rice wax (TOWAX-3F16, available from TOA KASEI CO., LTD.): 3 parts

Carbon black (#44, available from Mitsubishi Chemical Corporation): 10 parts

Azo iron compound (T-77, available from Hodogaya Chemical Co., Ltd., referred to as "CCA1"): 1.8 parts To 100 parts by mass of the obtained toner base particles, 2 parts by mass of HMDS-treated hydrophobic silica (RX200, available from NIPPON AEROSIL CO., LTD.) having an average particle diameter of 12 nm were added to obtain Toner 1. Physical properties of the toner are presented in Table 3.

Examples 2 to 5

Each toner was obtained in the same manner as in Example 1, except that the toner composition was changed to the toner composition presented in Table 3.

Physical properties of the toners are presented in Table 3.

Example 6

A toner was obtained in the same manner as in Example 1, except that the toner composition was changed to the toner composition presented in Table 3, and the rotational speed of Henschel Mixer (FM20B, available from NIPPON COKE & ENGINEERING CO., LTD.) was changed to 2,500 rpm. Physical properties of the toner are presented in Table 3.

Example 7

A toner was obtained in the same manner as in Example 1, except that the toner composition was changed to the toner composition presented in Table 3, and the amount of CCA1 was changed to 0.9 parts by mass. Physical properties of the toner are presented in Table 3.

Example 8

A toner was obtained in the same manner as in Example 1, except that the toner composition was changed to the toner composition presented in Table 3, and the range of the barrel temperature was changed to the range of 80 degrees Celsius through 110 degrees Celsius. Physical properties of the toner are presented in Table 3.

Example 9

A toner was obtained in the same manner as in Example 1, except that the toner composition was changed to the toner composition presented in Table 3, and the amount of the wax was changed to 2.0 parts by mass. Physical properties of the toner are presented in Table 3.

Example 10

A toner was obtained in the same manner as in Example 1, except that the toner composition was changed to the toner composition presented in Table 3, and the charge-controlling agent was changed to an azo iron compound (T-159, available from Hodogaya Chemical Co., Ltd., referred to as "CCA2") represented by Structural Formula (2). Physical properties of the toner are presented in Table 3.

Comparative Examples 1 to 2

Each toner was obtained in the same manner as in Example 1, except that the toner composition was changed to the toner composition presented in Table 3.

Physical properties of the toners are presented in Table 3.

Comparative Example 3

A toner was obtained in the same manner as in Example 1, except that the rotational speed of Henschel Mixer (FM20B, available from NIPPON COKE & ENGINEERING CO., LTD.) was changed to 1,500 rpm. Physical properties of the toner are presented in Table 3.

TABLE 3

| | Resins | | | | Average circularity | | Charge-controlling agent | | Release agent | |
|---|---|---|---|---|---|---|---|---|---|---|
| | Resin A | | Resin B | | 0.70 or greater but 0.85 or less proportion | less than 0.70 proportion | | surface-exposed | | surface-exposed |
| Item Unit | type | parts by mass | type | parts by mass | (%) in all of toner particles | (%) in all of toner particles | parts by mass | ratio % by mass | parts by mass | ratio % by mass |
| Ex. 1 | A-1 | 50 | B-1 | 50 | 15.8 | 2.8 | 1.8 | 0.030 | 3.0 | 0.041 |
| Ex. 2 | A-1 | 60 | B-4 | 40 | 19.3 | 9.5 | 1.8 | 0.045 | 3.0 | 0.042 |
| Ex. 3 | A-1 | 50 | B-1 | 50 | 10.8 | 1.2 | 1.8 | 0.035 | 3.0 | 0.038 |
| Ex. 4 | A-1 | 50 | B-3 | 50 | 18.9 | 1.6 | 1.8 | 0.038 | 3.0 | 0.042 |
| Ex. 5 | A-2 | 70 | B-2 | 30 | 12.5 | 5.5 | 1.8 | 0.040 | 3.0 | 0.041 |
| Ex. 6 | A-3 | 60 | B-3 | 50 | 16.5 | 6.9 | 1.8 | 0.068 | 3.0 | 0.041 |
| Ex. 7 | A-3 | 50 | B-3 | 50 | 12.5 | 2.0 | 0.9 | 0.020 | 3.0 | 0.040 |
| Ex. 8 | A-3 | 50 | B-3 | 50 | 17.6 | 7.8 | 1.8 | 0.046 | 3.0 | 0.091 |
| Ex. 9 | A-3 | 50 | B-3 | 50 | 12.8 | 2.0 | 1.8 | 0.028 | 2.0 | 0.013 |
| Ex. 10 | A-3 | 50 | B-3 | 50 | 16.2 | 3.2 | 1.8 | 0.038 | 3.0 | 0.039 |
| Comp. Ex. 1 | A-1 | 70 | B-4 | 30 | 24.3 | 11.8 | 1.8 | 0.043 | 3.0 | 0.040 |
| Comp. Ex. 2 | A-1 | 40 | B-1 | 60 | 9.2 | 1.2 | 1.8 | 0.034 | 3.0 | 0.041 |
| Comp. Ex. 3 | A-3 | 50 | B-30 | 50 | 18.4 | 12.2 | 1.8 | 0.092 | 3.0 | 0.042 |

| | | THF-soluble component | | | | | |
|---|---|---|---|---|---|---|---|
| Item Unit | THF-insoluble component | molecular weight of main peak | half-value width of main peak | MW 2,000 or less % by mass | MW 100,000 or more % by mass | Charge-controlling agent type | Toner No. |
| Ex. 1 | 22 | 14,900 | 86,800 | 20.8 | 9.2 | CCA1 | 1 |
| Ex. 2 | 11 | 11,000 | 89,000 | 24.2 | 5.5 | CCA1 | 2 |
| Ex. 3 | 35 | 14,200 | 77,400 | 17.1 | 8.6 | CCA1 | 3 |
| Ex. 4 | 20 | 16,800 | 71,000 | 16.2 | 7.3 | CCA1 | 4 |
| Ex. 5 | 15 | 12,100 | 66,000 | 24.5 | 7.1 | CCA1 | 5 |
| Ex. 6 | 22 | 14,900 | 86,805 | 20.8 | 9.2 | CCA1 | 6 |
| Ex. 7 | 22 | 14,900 | 96,800 | 20.8 | 9.2 | CCA1 | 7 |
| Ex. 8 | 22 | 14,900 | 86,800 | 20.8 | 9.2 | CCA1 | 8 |
| Ex. 9 | 22 | 14,900 | 86,800 | 20.8 | 9.2 | CCA1 | 9 |
| Ex. 10 | 22 | 14,900 | 86,800 | 20.8 | 9.2 | CCA2 | 10 |
| Comp. Ex. 1 | 8 | 9,000 | 92,000 | 26.3 | 5.5 | CCA1 | 11 |
| Comp. Ex. 2 | 42 | 16,500 | 56,300 | 14.2 | 10.3 | CCA1 | 12 |
| Comp. Ex. 3 | 22 | 14,900 | 96,800 | 20.8 | 9.2 | CCA1 | 13 |

(Evaluation Methods)

The following evaluations were performed on the toners obtained above.

<Evaluation of Background Smear>

IPSiO SP C220 available from Ricoh Company Limited was modified. The modified device was charged with 13.5 g of the above-obtained toner, and SCOTCH TAPE was adhered to an entire surface of an exposed area of a photoconductor operation of which was suspended during printing of a blank sheet. The peeled SCOTCH TAPE was adhered to Type 6000T paper available from Ricoh Company Limited and was then stored. A value of L* on the tape was measured by X-rite (available from Videojet X-Rite K.K.). Evaluation criteria are as described below.

(Evaluation Criteria)

A: L* was 92.0 or greater

B: L* was 91.0 or greater but less than 92.0

C: L* was 90.0 or greater but less than 91.0

D: L* was less than 90.0

<Evaluation of Blade-Adherence Resistance>

A developing unit of IPSiO SP C220 available from Ricoh Company Limited was charged with 20 g of each of the above-obtained toners and a blade-adherence evaluation was performed by means of an external idle machine. The blade adherence was confirmed every 5 minutes by visually observing lines derived from the adherence in the areas of the developing roller at the image forming section where each area was from each edge of the developing roller to a position that was 5 cm from the edge. Evaluation criteria are as described below.

(Evaluation Criteria)

A: the time during which the blade adherence occurred was 120 minutes or longer

B: the time during which the blade adherence occurred was 60 minutes or longer but shorter than 120 minutes C: the time during which the blade adherence occurred was 30 minutes or longer but shorter than 60 minutes D: the time during which the blade adherence occurred was shorter than 30 minutes <Evaluation of Fixing Ability>

—Low Temperature Fixing Ability—

IPSiO SP C220 available from Ricoh Company Limited was modified and the modified device was charged with the toner. The device was set in a manner that an amount of the toner deposition on Type 6000T paper available from Ricoh Company Limited was to be 10 g/m$^2$, and the paper on which an unfixed square solid image having a side of 40 mm was formed was prepared.

Next, the prepared unfixed solid image was passed through a modified fixing unit of IPSiO SP 4510SF available from Ricoh Company Limited with setting the system speed to 240 mm/sec, to thereby fix the image. The test was performed by varying the fixing temperature from 120 degrees Celsius through 160 degrees Celsius by 2 degrees Celsius. The output images were visually observed and the temperature at which unintentional toner transfer did not occur on the white background region was determined as the minimum fixing temperature. Evaluation criteria are as described below.

(Evaluation Criteria)

A: the minimum fixing temperature was lower than 130 degrees Celsius

B: the minimum fixing temperature was 130 degrees Celsius or higher but lower than 140 degrees Celsius C: the minimum fixing temperature was 140 degrees Celsius or higher but lower than 150 degrees Celsius D: the minimum fixing temperature was 150 degrees Celsius or higher —High-Temperature Release Properties—

IPSiO SP C220 available from Ricoh Company Limited was modified. The modified device was charged with the toner. An unfixed square-solid image having a side of 40 mm was printed on Type 6000T available from Ricoh Company Limited by setting the device in a manner that a deposition amount was to be 10 g/m$^2$.

Next, the prepared unfixed solid image was passed through the modified fixing unit of IPSiO SP 4510SF available from Ricoh Company Limited with setting the system speed to 240 mm/sec to thereby fix the image. The test was performed by varying the fixing temperature from 160 degrees Celsius through 200 degrees Celsius by 2 degrees Celsius. The output images were visually observed and the temperature at which unintentional toner transfer did not occur on the white background region was determined as the maximum fixing temperature.

(Evaluation Criteria)

A: the maximum fixing temperature was 210 degrees Celsius or higher

B: the maximum fixing temperature was 190 degrees Celsius or higher but lower than 210 degrees Celsius C: the maximum fixing temperature was 170 degrees Celsius or higher but lower than 190 degrees Celsius D: the maximum fixing temperature was lower than 170 degrees Celsius <Evaluation of Cleaning Properties>

The developing unit of IPSiO SP C220 available from Ricoh Company Limited was charged with 20 g of the above-obtained toner. The toner smear on a surface of the charging roller was collected by adhering and peeling a tape per certain sheets (image output of a chart having an imaging area rate of 5% on 1,000 sheets as a standard) and the deposited toner smear was visually judged or judged by measuring a density. In this test, judgement by visual observation was used. Evaluation criteria are as follows.

(Evaluation Criteria)

B: there was no toner smear and no adverse effect on an image

C: toner smear was slightly observed

D: toner smear was confirmed and toner lines were formed on an image.

As a comprehensive evaluation, it was judged as "I" when all of the results of the evaluation items were "B" or higher, it was judged as "II" when all of the results of the evaluation items were "C" or higher, and it was judged as "III" when the result of at least one item was "D." In the comprehensive evaluation, "III" was an unacceptable level, "II" and "I" were acceptable levels, and "I" indicated the better result than "II."

The evaluation results of Examples and Comparative Examples are presented in Table 4.

TABLE 4

| | Background smear | | Resistance to blade adherence | | Fixing ability: low-temperature fixing ability | | Fixing ability: high-temperature fixing ability | | Cleaning properties | Comprehensive |
|---|---|---|---|---|---|---|---|---|---|---|
| | L* | Evaluation | time (min) | Evaluation | (° C.) | evaluation | (° C.) | evaluation | evaluation | evaluation |
| Ex. 1 | 92.4 | A | 135 | A | 125 | A | 190 | B | B | I |
| Ex. 2 | 90.3 | C | 55 | C | 120 | A | 172 | C | B | II |
| Ex. 3 | 93.0 | A | 105 | B | 135 | B | 220 | A | B | I |
| Ex. 4 | 91.5 | B | 50 | C | 145 | C | 200 | B | B | II |
| Ex. 5 | 91.2 | B | 45 | C | 125 | A | 185 | C | B | II |
| Ex. 6 | 90.5 | C | 40 | C | 124 | A | 190 | B | B | II |
| Ex. 7 | 90.2 | C | 125 | A | 125 | A | 190 | B | B | II |
| Ex. 8 | 91.9 | B | 35 | C | 118 | A | 180 | C | B | II |
| Ex. 9 | 92.6 | A | 140 | A | 148 | C | 220 | A | B | II |
| Ex. 10 | 92.5 | A | 125 | A | 124 | A | 190 | B | B | I |

TABLE 4-continued

| | Background smear | | Resistance to blade adherence time | | Fixing ability: low-temperature fixing ability | | Fixing ability: high-temperature fixing ability | | Cleaning properties | Comprehensive |
|---|---|---|---|---|---|---|---|---|---|---|
| | L* | Evaluation | (min) | Evaluation | (° C.) | evaluation | (° C.) | evaluation | evaluation | evaluation |
| Comp. Ex. 1 | 88.4 | D | 20 | D | 120 | A | 165 | D | B | III |
| Comp. Ex. 2 | 92.8 | A | 140 | A | 138 | B | 220 | A | D | III |
| Comp. Ex. 3 | 88.2 | D | 15 | D | 124 | A | 190 | B | D | III |

It was found from the results presented in Table 4 that the toner of the present disclosure could suppress adherence to a regulating blade, could secure sufficient cleaning properties, could give less background smear, and had excellent fixing properties compared to the toners of Comparative Examples.

REFERENCE SIGNS LIST

10: electrostatic-latent-image bearer (photoconductor drum)
10K: electrostatic-latent-image bearer for black
10Y: electrostatic-latent-image bearer for yellow
10M: electrostatic-latent-image bearer for magenta
10C: electrostatic-latent-image bearer for cyan
14: roller
15: roller
16: roller
17: cleaning device
18: image-forming unit
20: charging roller
21: exposing device
22: secondary transferring device
23: roller
24: secondary-transfer belt
25: fixing device
26: fixing belt
27: press roller
28: sheet reverser
32: contact glass
33: first carriage
34: second carriage
35: image forming lens
36: reading sensor
40: developing device
41: developing belt
42K: developer stored unit
42Y: developer stored unit
42M: developer stored unit
42C: developer stored unit
43K: developer-supply roller
43Y: developer-supply roller
43M: developer-supply roller
43C: developer-supply roller
44K: developing roller
44Y: developing roller
44M: developing roller
44C: developing roller
45K: black developing unit
45Y: yellow developing unit
45M: magenta developing unit
45C: cyan developing unit
49: registration roller
50: intermediate transfer belt
51: roller
52: separation roller
53: manual paper feeding path
54: bypass feeder
55: switch craw
56: ejection roller
57: paper ejection tray
58: corona-charging device
60: cleaning device
61: developing device
62: transfer roller
63: cleaning device
64: charge-eliminating lamp
70: charge-eliminating lamp
80: transfer roller
90: cleaning device
95: transfer paper
100A, 100B, 100C: image forming device
101: electrostatic-latent-image bearer
102: charging device
103: exposure from exposing device
104: developing device
105: recording paper
107: cleaning unit
108: transfer roller
120: image forming unit
130: document table
142: paper feeding roller
143: paper bank
144: paper feeding cassette
145: separation roller
146: paper feeding path
147: conveyance roller
148: paper feeding path
150: photocopier main body
160: charging roller
200: paper feeding table
300: scanner
400: automatic document feeder (ADF)

The invention claimed is:

1. A toner comprising:
a binder resin;
a release agent; and
a charge-controlling agent,
wherein the toner includes toner particles having particle diameters of 3 micrometers or smaller,
among the toner particles having particle diameters of 3 micrometers or smaller, a proportion of the toner particles having a circularity of 0.70 or greater but 0.85 or less in all of the toner particles is 10% by number or greater but less than 20% by number and a proportion of the toner particles having a circularity of less than 0.70 in all of the toner particles is 10% by number or less.

2. The toner according to claim 1, wherein among the toner particles having particle diameters of 3 micrometers or smaller, the proportion of the toner particles having the circularity of less than 0.70 in all of the toner particles is 5% by number or less.

3. The toner according to claim 1, wherein an amount of the charge-controlling agent relative to 100 parts by mass of the binder resin is 0.5 parts by mass or greater but 3.0 parts by mass or less, and a surface-exposed ratio of the charge-controlling agent relative to the binder resin is 0.02% or greater but 0.07% or less.

4. The toner according to claim 1, wherein an amount of the release agent relative to 100 parts by mass of the binder resin is 1.0 parts by mass or greater but 6.0 parts by mass or less, and a surface-exposed ratio of the release agent relative to the binder resin is 0.02% or greater but 0.10% or less.

5. The toner according to claim 1, wherein the toner includes a THF-insoluble component in an amount of 10% by mass through 40% by mass, a molecular-weight distribution of a THF-soluble component of the toner obtained by gel permeation chromatography (GPC) has a main peak between 10,000 and 16,000, where a half-value width of the main peak is a molecular weight of 60,000 through 90,000, and within the THF-soluble component of the toner, a component having a molecular weight of 2,000 or less as determined by GPC is from 15.0% by mass through 25.0% by mass and a component having a molecular weight of 100,000 or greater as determined by GPC is 10.0% by mass or less.

6. The toner according to claim 1, wherein the charge-controlling agent is an azo iron dye.

7. An image forming method comprising:

forming an image by one-component development using the toner according to claim 1.

8. An image forming apparatus comprising:

an electrostatic-latent-image bearer;

an electrostatic latent image-forming unit configured to form an electrostatic latent image on the electrostatic-latent-image bearer; and a developing unit including a developer and configured to develop the electrostatic latent image with the developer to form a visible image, wherein the developer includes the toner according to claim 1.

9. A process cartridge comprising:

an electrostatic-latent-image bearer; and a developing unit including a developer and configured to develop an electrostatic latent image formed on the electrostatic-latent-image bearer with the developer to form a visible image, wherein the process cartridge is detachably mounted in a main body of an image forming apparatus, and the developer includes the toner according to claim 1.

10. The toner of claim 1, wherein the toner particles having particle diameter of 3 micrometers or smaller each include a polyester resin.

11. The toner of claim 1, wherein the charge-controlling agent comprises an azo iron dye of formula (1) and/or azo iron dye of formula (2)

(I)

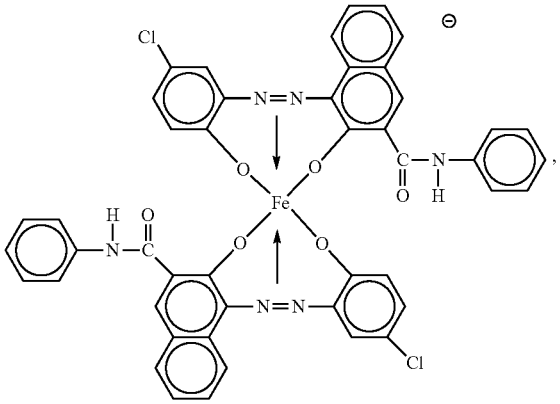

(II)

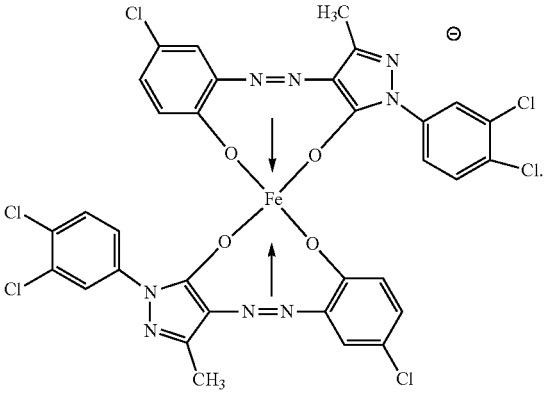

12. The toner of claim 11, wherein the azo iron dye further comprises an ammonium, alkyl ammonium, and/or an alkali metal cation.

13. The toner of claim 1, wherein the binder comprises a polyester comprising, in a polymerized form:

ethylene glycol, diethylene glycol, triethylene glycol, propylene glycol, 1,4-bis(hydroxymethyl)cyclohexane, and/or bisphenol A; and maleic acid, fumaric acid, phthalic acid, isophthalic acid, terephthalic acid, succinic acid, malonic acid, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and/or 1,2,7,8-octanetetracarboxylic acid.

14. The toner of claim 1, wherein the binder comprises a polyester comprising, in a polymerized form:

ethylene glycol, diethylene glycol, triethylene glycol, and/or propylene glycol;

(i-b) 1,4-bis(hydroxymethyl)cyclohexane and/or bisphenol A:

(ii-a) maleic acid, fumaric acid, phthalic acid, isophthalic acid, terephthalic acid, succinic acid, and/or malonic acid; and (ii-b) 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and/or 1,2,7,8-octanetetracarboxylic acid.

15. The toner of claim 1, wherein the binder comprises a polyester comprising, in a polymerized form:

ethylene glycol;
bisphenol A;
fumaric acid, terephthalic acid, and/or succinic acid; and
1,2,4-benzenetricarboxylic acid.

16. The toner of claim 1, wherein the binder comprises only polyester.

17. The toner of claim 1, wherein, among the toner particles having the particle diameters of 3 micrometers or smaller, the proportion of the toner particles having the circularity in the range of from 0.70 to 0.85 relative to the total number of the toner particles is in a range of from 10 to 15%.

18. The toner of claim 1, wherein the surface-exposed ratio of the charge-controlling agent to the binder resin in a range of from 0.02 to 0.05%, and wherein the surface-exposed ratio of the release agent to the binder resin is in a range of from 0.02 to 0.06%.

19. The toner of claim 18, wherein an amount of the charge-controlling agent is in a range of from 0.5 to 2.0 parts by mass, and wherein an amount of the release agent is in a range of from 1.0 to 6.0 parts by mass, relative to 100 parts by mass of the binder resin.

20. The toner of claim 1, comprising a first and a second polyester, wherein the first and second polyesters are different.

* * * * *